United States Patent [19]

Meyers et al.

[11] 4,177,975

[45] Dec. 11, 1979

[54] EXHAUST HOOD APPARATUS WITH TILTING FURNACE

[75] Inventors: Leo J. Meyers; Louis A. Grant, both of Pittsburgh, Pa.

[73] Assignee: Louis A. Grant, Inc., Pittsburgh, Pa.

[21] Appl. No.: 915,511

[22] Filed: Jun. 14, 1978

[51] Int. Cl.[2] ..... C21B 7/22

[52] U.S. Cl. ..... 266/158; 98/115 R; 266/245

[58] Field of Search ..... 266/158, 144, 155, 156, 266/157, 159, 248, 245, 246, 247; 75/4, 5, 59, 60; 98/115 R, 115 LH, 115 SB, 115 VM; 126/299 R, 299 C, 299 F

[56] References Cited

U.S. PATENT DOCUMENTS

| | | | |
|---|---|---|---|
| 3,205,810 | 9/1965 | Rosenak | 266/158 |
| 3,415,179 | 12/1968 | Scheel | 266/158 |
| 3,602,128 | 8/1971 | Lindkuist | 98/115 VM |
| 3,809,376 | 5/1974 | Plazier | 266/158 |
| 3,854,709 | 12/1974 | Gaw | 98/115 R |

FOREIGN PATENT DOCUMENTS

| | | | |
|---|---|---|---|
| 2305666 | 10/1976 | France | 98/115 VM |

*Primary Examiner*—L. Dewayne Rutledge
*Assistant Examiner*—Michael L. Lewis
*Attorney, Agent, or Firm*—Parmelee, Miller, Welsh & Kratz

[57] ABSTRACT

The exhaust hood above a metallurgical furnace, where the furnace has an open top and is supported to move in a vertical arc beneath the hood from an upright position to tilt in one direction to a charging position and in the other direction to a tapping position, terminates in an opening which is usually circular and of a diameter such that it may receive gases and dust from the open top of the furnace when the furnace is tilted to one side or the other, as well as when it is vertical. A frame structure supported above the opening in the hood and arranged to be shifted horizontally relative to the hood has a panel suspended therefrom with operating means on the frame for swinging the panel in a vertical arc from a storage position where it is removed from the space between the top of the furnace and the hood downwardly to a level below the open end of the hood and then upwardly against the bottom of the hood to close the greater portion of the bottom of the hood and leave but a segment of the bottom open. Another operating means selectively moves the frame relative to the hood to determine which one of two segments to the right or left of the vertical axis about which the furnace tilts will be open. The panel is preferably comprised of louvers which are closed when the panel is in an operating position against the open end of the hood but which open when the panel is being moved through its arc of travel between an operating position against the bottom of the hood to its inoperative or storage position to thereby discharge from the panel accumulated dust and perhaps other solids.

12 Claims, 4 Drawing Figures

EXHAUST HOOD APPARATUS WITH TILTING FURNACE

This invention is for an apparatus for use with certain types of metallurgical furnaces of which a basic oxygen furnace (BOF) is a familiar example. Such a furnace has an open top from which gases flow vertically into the central area of an exhaust hood positioned above the furnace during the operation of the furnace in refining a charge of metal, but the furnace is arranged to be tilted to one side or the other from the vertical position to afford access to the open top of the furnace when a charge to be refined is to be introduced into the top of the furnace, and the furnace is tilted to the opposite side of center when a charge of metal is to be tapped after the melt has been refined. This invention provides an apparatus for more effectively increasing the flow of gases and dust upwardly into the hood with less diversion of the gas flow into the atmosphere, especially at such times as the furnace is tilted to one side or the other from a vertical position and the path of travel of the gases at such times is longer and less directly into the hood.

It has heretofore been proposed (see U.S. Pat. No. 3,854,709 granted Dec. 17, 1974 to R. G. Gaw) to provide parallel rails at each side of and at a level below the open lower end of the hood. These rails are parallel to the tilting plane of the furnace, and a plate is movable along these rails from a position clear of the opening to a position where it extends under the hood, this plate being of less width in the direction of travel of the plate than the diameter of the opening in the hood across which it moves. With the furnace in vertical operating position, this plate is then completely withdrawn from beneath the opening, but if the furnace is tilted, for example to the left, the damper plate would be moved its full limit to the right, leaving the left segment of the open end of the hood unobstructed so that gases can enter the reduced opening at the left. If the furnace is tilted to the right, the plate is then moved horizontally to the left to a limited extent, leaving the right segment of the hood entrance open. This had several drawbacks in that it was only partially effective for the purpose because of the working clearances required and the resulting unwanted influx of ambient air around the periphery, the accumulation of dust and solids on the top surface of the damper plate, and other drawbacks not here necessary to enumerate.

Our invention provides an improved arrangement wherein parallel horizontal rails are provided, one at each side of the exhaust hood relatively high above its open lower end and high above the arc in which the furnace tilts and several feet higher above the shop floor than apparatus heretofore provided. There is a frame arranged to travel a limited distance on these rails in a direction parallel with the vertical plane in which the furnace tilts. A means is provided for selectively shifting this frame along the supporting rails the required limited distance of travel.

The flow control panel is suspended from this movable frame to swing in a vertical arc from a position sometimes called herein the "storage" position, entirely above and to one side of the open bottom end of the exhaust hood downwardly to a level below the lower end of the hood and then upwardly to a position where it is tight against the lower end of said hood and, of course, in the reverse direction. Operating means mounted entirely on the movable frame effects the arcuate movement of the panel through its arc of travel separately from a second means that moves the frame along the rails to select the position of the frame relative to the open end of the hood and thereby determine which portion of the open end of the exhaust hood will be closed when the damper is operated from the full open, or storage, position to the closed position against the lower end of the exhaust hood.

A further improvement of this invention is provided by having the damper panel formed of louvers which are closed when the panel is in an operating position against the bottom end of the hood to an open position as the panel moves through its arc of travel from the operating position to a position at one side of the hood to thereby discharge any accumulation of dust and other solids with each operation of the panel. Visual inspection of the louvers may be readily performed when they are tilted in this manner.

The invention may be understood by reference to the accompanying drawings showing a preferred embodiment of the invention in relation to a conventional BOF assembly.

FIG. 1 is a side elevation showing more or less schematically the upper portion of the BOF and its relation to the exhaust hood positioned above the furnace, the furnace being shown in full lines tilted from a vertical position to the left, or counterclockwise as here viewed, to its charging position, while its vertical operating or "blowing" position is shown in broken lines. The arc of movement of the top of the furnace from its charging position to its pouring position at the right of the vertical position is indicated by a dot-and-dash line. The panel of this invention is shown over the hood opening in full line position, and its arc of travel and intermediate positions are shown in dotted lines.

Figures 1, 2:
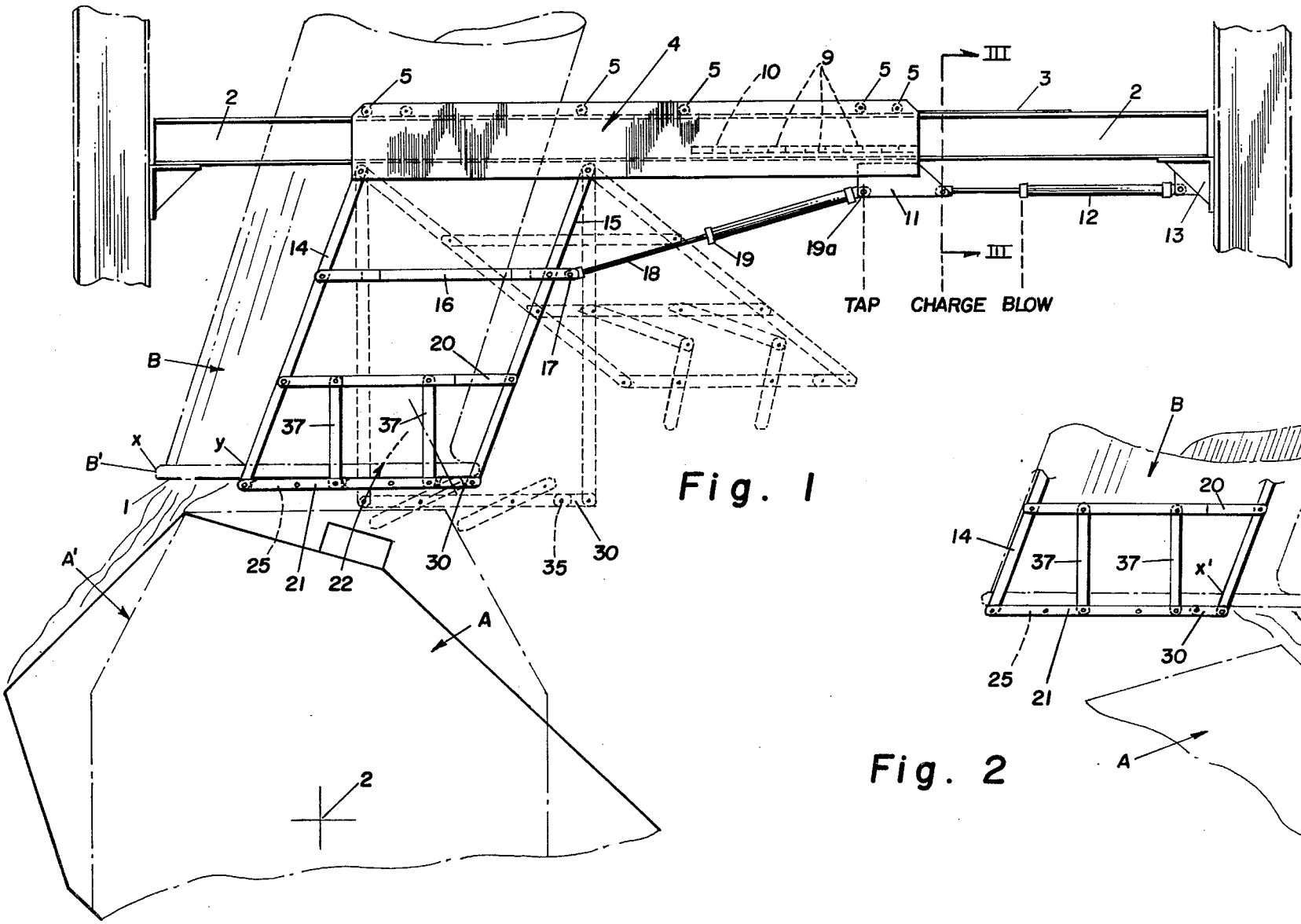
FIG. 2 is a fragmentary view similar to FIG. 1 but with the damper panel shifted relative to the hood to its position at the left of the opening when the furnace is tilted to the right of its vertical position for pouring its molten contents.

In the drawings, A indicates the upper portion of a conventional BOF with a generally cylindrical body tapered in the direction of the top A', the top being open. As here shown in full lines, the furnace is tilted about an axis at 2 toward the left or charging position while dot-and-dash lines show it at its vertical position and, in FIG. 3, it is shown in full lines tilted to the right to its tapping position. Above the furnace is the customary exhaust hood B which, at its lower end, terminates in an opening which is generally circular and is surrounded by a rim B'. This is a generally common arrangement with furnaces of this type.

Figure 3:
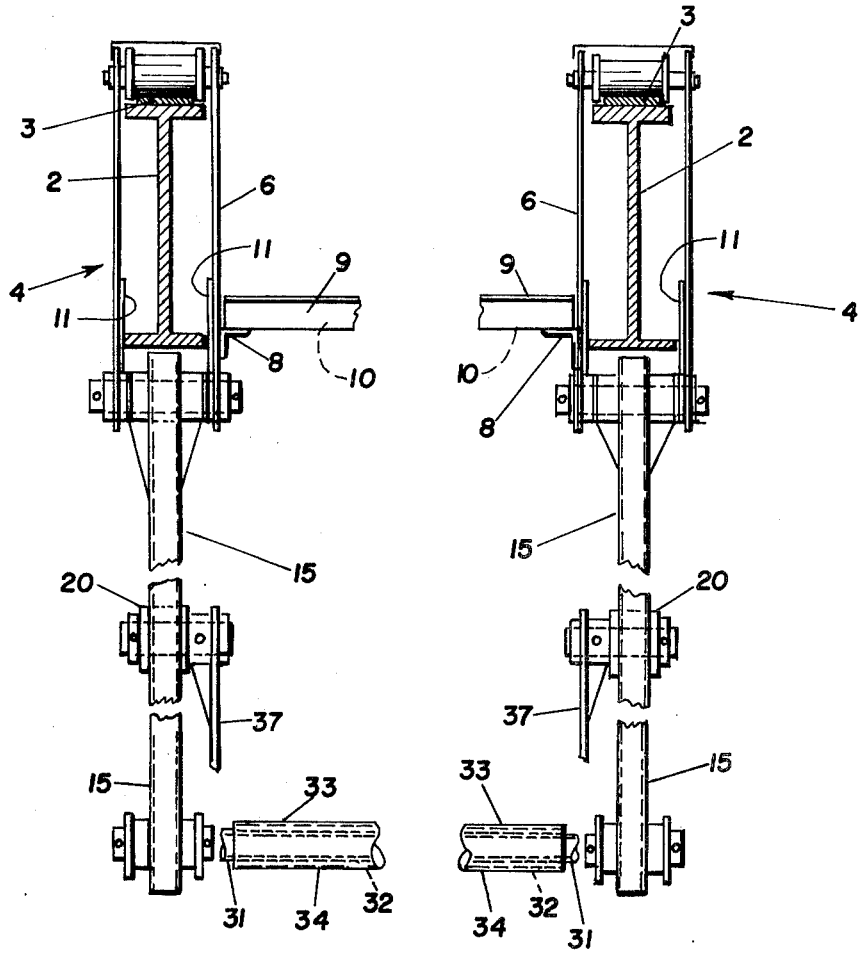
FIG. 3 is principally a rear elevation, that is, viewing the apparatus as shown in FIG. 1 from the left, the supporting rails, however, being shown in transverse section in the plane of line III—III of FIG. 1, the view being on a larger scale than FIGS. 1 and 2.

The present invention, which is for an accessory apparatus for use with this and similar tilting furnaces, comprises two parallel similar structural sections 2, preferably I-beams, as best seen in FIG. 3, located some distance above the bottom of the exhaust hood and both being structurally independent of the hood. Each beam 2 has a guide rail or track 3 on its top flange. There is a frame structure comprising an elongated, longitudinally extending shoe, designated generally as 4, with rollers 5 at intervals therealong that roll on and are guided by the respective tracks 3 to enable the shoes to move along the rails the required limited distance. Each shoe has inner and outer side plates 6 and 7, respectively, extending therealong, one at each side of the I-beam along which it is movable. The inner or confronting side plates 6 have angle bars 8 rigidly affixed thereto. Cross members 9 formed of rectangular tubes provide a rigid platform 10 connecting the two shoes at a distance sufficiently removed to the right of the exhaust hood that, in the back and forth travel of the frame comprising said two shoes, the platforms are at all times clear of contact with the exhaust hood.

At the right or rear end of each shoe there is a plate 11 to which a fluid pressure operated piston and cylinder unit 12 is attached. One end of the cylinder has a clevis connected at 13 to a fixed bracket under the right end of the I-beam 2. The outermost end of the piston is connected to plate 11. As indicated on the drawing, the piston moves between three positions, the center one being the one in which the movable frame is located when the furnace is tilted to the charge position, the position to the left of the charge position being marked "TAP" and is the position to which the frame is moved when the furnace is tilted to the right of vertical to empty the molten charge into receiving means, not shown, while the position further to the right is marked "BLOW" and is the position to which the frame is moved when the furnace is vertical. The significance of this change of positions will hereafter appear.

Depending from each of the shoes is a pair of parallel levers 14 and 15, 14 designating the one to the right as seen in FIGS. 1, and 15, seen both in FIGS. 1 and 3, being the other, with such lever of the pair being pivotally attached at its upper end from the shoe on which it is carried. The two levers of each pair are pivotally connected for parallel movement by a horizontal bar 16. The right end of this bar is pivotally connected at 17 to the piston rod 18 of a fluid pressure operated piston and cylinder unit 19, the cylinder of which is pivotally attached at 19*a* to the forward or left end of the plates 11 so that the parallel levers and their operating means comprising piston and cylinder unit 19 are all carried on the movable frame and the frame can move back and forth entirely independently of the position of the parallel levers, but it will be realized that such movement of the frame would not be attempted with the panel assembly, hereinafter described, tight against the lower end of the hood.

Below the bar 16 there is a second horizontal bar 20 pivotally connecting the two levers 14 and 15 and below this is still a third connecting bar 21 pivotally connecting the lower ends of the levers 14 and 15. The bar 21 and its counterpart on the opposite side of the exhaust hood, and therefore not shown in the drawings, constitute side frame members for the draft control panel, designated generally as 22.

In FIG. 1 the panel is shown in full lines seated tight against the bottom rim B′ of the hood. In this position it closes all of the bottom opening into the flue except that segment to the left of the center of said open end, generally indicated between points X and Y in FIG. 1. This open area is above the end of the furnace in its charging position so that, as indicated by the arrows, gases and dust emerging from the top of the furnace are drawn upwardly into the open end of the hood and all of the updraft in the hood is concentrated in this open area. The draft therefore is not diluted with ambient air sucked in from all around, as would be the case if the panel were not provided and if it were not tightly fitted against the rim B′ of the opening into the hood. Therefore, even with the end of the furnace tilted away from the hood, there is little or no diversion of the furnace gases into the surrounding atmosphere.

If, however, the furnace is tilted to the right to the pouring position, the panel should close the left end of the flue inlet opening and, as shown in FIG. 2, the right end of the hood should be uncovered, as between X′ and Y′. This is accomplished by first lowering the panel away from the rim of the hood and then operating the fluid pressure cylinder piston units 12 to move or shift the frame to the left relative to the hood, that is, to the TAP position. Then when the damper panel is raised against the bottom rim of the hood opening, the area X-Y will be covered along with most of the remaining area of the opening, and the segmental area between X′–Y′ only will be open to draw the fumes and gases and dust up from the open end of the furnace.

In the normal operation of a furnace of this type, it is not usual for the furnace to tilt from the charge position to the pouring position, but there will be an intervening period when the furnace is vertical and material charged into the furnace will be refined, as in a BOF where oxygen is blown down into the furnace from a lance (not shown) in a well-known manner. Therefore, after the furnace has been charged, the panel will be moved in an arc by operation of the fluid pressure cylinder and piston 18–19 to swing the parallel levers 14 and 15 toward the right, causing the damper panel to move in an arc downwardly and toward the right, as seen in dotted lines in FIG. 1, until the panel is at a level below the opening in the hood. Then the cylinder and piston unit 12 is operated to pull the frame to its extreme limit of travel to the right, as viewed in FIG. 1, which is the "blow" position. At this time, fluid pressure unit 18–19 resumes operation, raising the levers up to almost a horizontal position at one side of the exhaust hood and entirely clear of the arc in which the furnace rocks. Only after the blow cycle is completed and the furnace is tilted to the "tap" position are hydraulic or fluid pressure jacks operated to swing the panel to a level below the bottom of the hood, the frame shifted to its extreme left-hand limit of travel and the panel raised to leave only the right end of the opening uncovered, as shown in FIG. 2.

Figure 4:
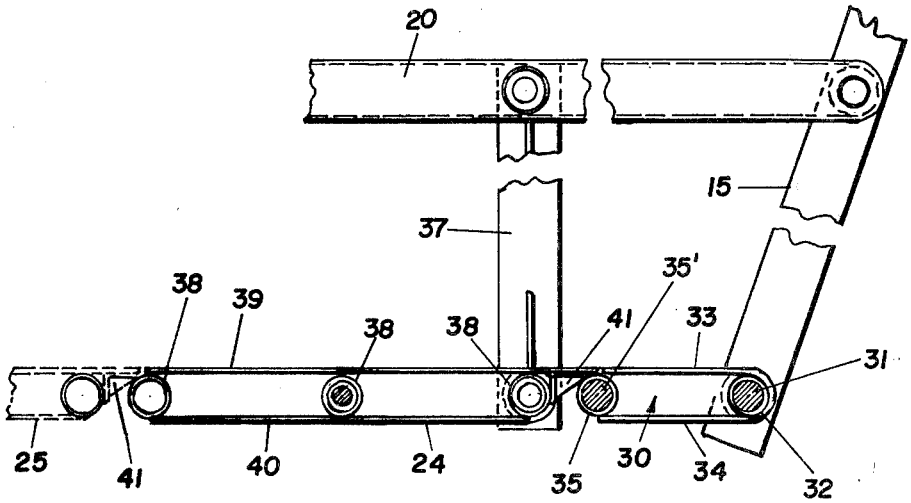
FIG. 4 is a fragmentary side elevation of the panel with the side bar removed to more clearly show the louvered construction of the body of the panel.

The structure includes a still further novel arrangement in that the damper panel is comprised of a plurality, and at least two, parallel louvers 24 and 25 supported in the side by the bars or side frame members 21 to pivot about their respective longitudinal axes and rotate from the normal overlapping position shown in FIG. 4 through an arc to a position edgewise to the normal closed position. In so doing, they dump from the panel any accumulation of solid matter that collects on them when they are in their horizontal positions where they close one area or the other of the exhaust flue opening. This rocking or partial rotation of the louvers 24 and 25 is accomplished automatically as the panel moves into and out of hood engaging position. To this end, the lower end of lever 15 is connected with the side bars 21 of the panel by a link 30, as indicated in FIGS. 1 and 2, and the details of which are shown in FIG. 4, where the side bars 21 are removed and the cross rods which constitute fixed pivots are shown in section, with the ends of the link 30 and the ends of the louvers being shown in elevation. As thus illustrated, the link 30 forms a narrow, non-tilting portion of the bottom panel with upper and lower plates 33 and 34 welded to similar sleeves 32 and 35 rotatably surrounding the respective pivot rods at 31 and 35'.

Parallel levers 37, pivotally connected at their upper ends to the horizontal bar 20, have their lower ends connected to the rear or right corners of the louvers 24 and 25. As before explained, this arrangement is duplicated on the other side of the hood, and cannot be seen in FIG. 1. As the levers 14 and 15 swing in an arc to the right from the position seen in FIG. 1, the bars 20 and 22 first move down and to the right. After the panel reaches its lowermost point of travel in this arc, the distance between them decreases as the parallel levers 37 begin to move from a vertical position, as shown by the dotted lines, causing the pivoted louvers to tilt in a counterclockwise direction and eventually, when they have been carried by the levers 14 and 15 clear to the side of the hood, they will be almost vertical, thereby dumping any accumulated dust and solids that may have collected on them. When the levers 14 and 15 are moved in the reverse direction from this position off to the side of the hood, the rotation of the louvers will be reversed so that, when the panel is back in position against the rim of the hood opening, they will be horizontal and will form a closed damper plate over that area of the opening which they cover.

As here shown, the louvers 24 and 25 are formed with a tube 38 along both its left and right edges and also midway between said edges. Metal upper and lower plates 39 and 40, respectively, are welded similarly to plates 33 and 34 to the tops and bottoms of the tubes 38 so that the louvers are relatively light in weight and are air-cooled because of the space between the plates being open at the end of the louvers. The rear or right edge of each louver has an angle bar 41 welded thereto that overlaps the adjacent tube of the next louver or panel element to avoid open spaces between the elements of the panel when the panel is in operating position over the flue opening and prevent overtravel of the louvers in a clockwise direction. As herein described, the panel unit is generally rectangular in shape with its greater dimension being transverse to the direction of travel of the movable overhead frame and greater than the maximum diameter or dimension of the end of the hood, but its dimension in the direction in which the frame moves is less than the diameter or dimension of the opening. It will therefore completely block the entrance of any appreciable air or gases into the hood, except in that area of the opening to one side or the other of the center of the hood, this opening desirably being less than 50% of the area of the open end of the exhaust hood, the open area not then covered by the panel unit being generally around 15% to 20% of the entire area of the open end of the hood.

It will therefore be seen that since the damper panel moves in a vertical arc instead of in a horizontal plane as heretofore proposed, added space between the hood and the top of the furnace to accommodate the damper panel is not necessary and a tighter closure may be made by, in effect, lifting the panel against the rim of the opening instead of sliding it horizontally below the rim. Also, with this travel it becomes feasible to form the panel with louvers that discharge accumulations of dirt and dust each time the panel is moved in an arc from a position below the hood to a position at one side of the hood when the blowing operation is to take place and, at this time, the panel and its supports are well removed from the intense heat immediately adjacent to the top of the furnace. By locating the movable frame and its supporting beams several feet above the bottom of the hood, there is much more "head room" above the shop floor for operation and manipulation of the oxygen lance for a BOF.

While we have shown the preferred arrangement where the damper swings in a plane parallel with the direction of movement of the shoes along the rails 2 and parallel with the arc in which the furnace tilts, the links 15 could be positioned from the movable frame to swing the damper panel in a plane at right angles to the length of the rails 2, should this for any reason be desirable or necessary.

We claim:

1. In the combination wherein there is a metallurgical furnace of the type having an open upper end for the discharge of gases and an exhaust hood over said upper end of the furnace and wherein the furnace is movable from a location where its open upper end is substantially centered under the hood to one side or the other of the central position, the hood having an open lower end, the area of which is larger than the open upper end of the furnace for receiving gaseous discharge from the furnace in any position to which the furnace is moved to one side or the other of the centered position, the improvement comprising an apparatus with:

(a) a movable frame structure positioned at a level above the open lower end of the hood and arranged to be shifted relatively to the hood in a direction parallel with the plane of movement of the open end of the furnace in one direction or the other from the centered position under the hood;

(b) a panel unit of an effective overall area greater than half the full open area of the hood but insufficient to completely cover said area;

(c) means suspending said panel from the movable frame for movement of the panel in a vertical arc from a position under and against the bottom of the hood to a position clear of the open bottom of the hood, and (d) means for selectively moving said frame relatively to the hood from a storage position where the panel unit is entirely clear of the hood for use when the furnace is centered under the opening in the hood to a charge position where the panel will cover all of that open end of the hood except that area through which gases from the furnace will flow when the top of the furnace is positioned to one side of the center of the opening to effect charging of the furnace or to a tap position where all of the open end of the hood except the area which is over the top of the furnace through which gases flow when the furnace is positioned in tapping position.

2. In the combination defined in claim 1 wherein the furnace tilts from a vertical position where its open end is substantially centered under the hood to a position at one side of the vertical position for charging the furnace and to the opposite side of the vertical position for tapping metal from the furnace.

3. The combination defined in claim 1 wherein said apparatus has the panel suspended from the frame by parallel levers arranged for the panel to move from a position entirely to one side of and above the lower end of the hood downwardly and toward the hood to a level below the lower end of the hood and then upwardly against the bottom edge of the hood.

4. The improvement defined in claim 3 wherein the apparatus has the frame supported on a track along which it is horizontally movable.

5. The improvement defined in claim 4 in which fluid pressure means fixed relatively to the track and attached to the frame is provided for selectively moving the frame along the track to vary its position relative to said opening in the hood.

6. The improvement defined in claim 4 in which means carried on the movable frame is arranged to effect the swinging of said parallel levers through a vertical arc.

7. The improvement defined in claim 3 in which the panel unit has side bars pivotally connected to the ends of the parallel levers whereby said side bars remain in a level position at all times.

8. The improvement defined in claim 7 in which the main area of the panel between the side bars is comprised of at least two louvers extending crosswise between the side bars and arranged to tilt from a horizontal plane relative to the side bars toward a vertical position during the travel of the side bars through their arc of movement toward one side of the hood and return to a horizontal position as the panel moves in the reverse direction to a position against the bottom of the hood.

9. The improvement defined in claim 8 wherein the louvers rotate about their respective longitudinal axes in relation to the side bars of the panel in which they are pivotally supported.

10. In the combination of a furnace having an open top for the discharge of gases and an exhaust hood with an open lower end spaced above the top of the furnace to receive exhaust gases from the furnace, the furnace being arranged to tilt from an upright position where the open top of the furnace is substantially centered under the open bottom of the hood to the right and to the left of the centered position, the open lower end of the hood being of an area to collect gases emerging from the top of the furnace when it is in the upright position or tilted to its full limit to one side or the other of the upright position, the improvement comprising an apparatus having a panel unit which will cover most of the bottom opening of the hood except that area which is over the right end of the furnace when the furnace is tilted to the right and all except the left side of the hood opening when the furnace is tilted to the left, said apparatus comprising a frame positioned above the lower end of the hood from which said panel is suspended, a selectively operated first means for shifting the frame and panel horizontally relative to the hood, and a second selectively operated means for moving the panel in a vertical arc from a starting position at one side of the hood to a position below the level of the hood and then upwardly against the open end of the hood to cover the area of the opening selected by the operation of said first means, and returning it to the starting position, said second operating means serving to hold the panel at one side of the hood when the furnace is centered under the hood.

11. In the combination defined in claim 10 the improvement in said apparatus wherein the panel unit comprises a plurality of louvers extending transversely of the panel and movable from a horizontal position when the panel is against the bottom lower end of the hood, and means for rotating said louvers about their longitudinal axes in a limited vertical arc when the panel unit is moved by said second operating means downwardly to a level below the bottom of the hood and to the side toward its starting position and again into a horizontal position when the panel is next operated to a position against the lower end of the hood.

12. In combination with a tilting metallurgical furnace open at its upper end and supported to tilt to the right or left from a vertical position wherein there is an exhaust hood positioned above the furnace with an inlet opening over the furnace beneath which the open top of the furnace is normally substantially centered during the usual operation of the furnace with the furnace in a vertical position, but with respect to which the open top of the furnace moves to one side or the other when the furnace is tilted from said vertical position, the invention comprising:

(a) a movable frame above the opening in the hood movable parallel with the long axis of the opening in the hood;

(b) means arranged to selectively move the frame in either direction toward which the furnace is tilted from one side or the other from its vertical position;

(c) a closure panel hung from said movable frame arranged to swing in a vertical arc from a position at one side of said opening entirely clear of the opening downward to a level below the plane of the opening in the hood and then upward to a position against the end of the hood over the opening of the hood, the panel being of a length sufficient to cover more than half of the opening but to selectively leave one segment only uncovered when the furnace is tilted in one direction and an opposite segment only when the furnace is tilted in the other direction from the vertical position.

* * * * *